United States Patent [19]

Iwami et al.

[11] Patent Number: 4,769,636

[45] Date of Patent: Sep. 6, 1988

[54] DISPLAY CONTROL METHOD FOR MULTI-WINDOW SYSTEM

[75] Inventors: Hidefumi Iwami, Yokohama; Tomihiko Kojima, Machida; Shouji Nakamura, Yokohama; Fumiya Murata, Hadano, all of Japan

[73] Assignee: Hitachi, Ltd., Tokyo, Japan

[21] Appl. No.: 895,848

[22] Filed: Aug. 12, 1986

[30] Foreign Application Priority Data

| | | | |
|---|---|---|---|
| Aug. 14, 1985 | [JP] | Japan | 60-177511 |
| Jan. 29, 1986 | [JP] | Japan | 61-15629 |
| Jan. 31, 1986 | [JP] | Japan | 61-17912 |
| Jan. 31, 1986 | [JP] | Japan | 61-17913 |

[51] Int. Cl.[4] ..... G09G 1/08

[52] U.S. Cl. ..... 340/724; 340/799; 364/522

[58] Field of Search ..... 340/721, 723, 724, 798, 340/799; 364/522

[56] References Cited

U.S. PATENT DOCUMENTS

| | | | |
|---|---|---|---|
| 4,542,376 | 9/1985 | Bass et al. | 340/723 X |
| 4,550,315 | 10/1985 | Bass et al. | 340/723 X |
| 4,559,533 | 12/1985 | Bass et al. | 340/724 |
| 4,586,035 | 4/1986 | Baker et al. | 340/723 X |
| 4,642,790 | 2/1987 | Minshull et al. | 340/723 X |
| 4,651,146 | 3/1987 | Lucash et al. | 340/721 |
| 4,653,020 | 3/1987 | Cheselka et al. | 340/721 X |
| 4,663,617 | 5/1987 | Stockwell | 340/724 X |
| 4,670,752 | 6/1987 | Marcoux | 340/721 |

FOREIGN PATENT DOCUMENTS

| | | | |
|---|---|---|---|
| 2559927 | 8/1985 | France | 340/721 |
| 2565052 | 11/1985 | France | 340/721 |
| 0102284 | 6/1984 | Japan . | |
| 0251431 | 12/1985 | Japan | 340/721 |
| 2126054 | 3/1984 | United Kingdom | 340/723 |

*Primary Examiner*—Theodore M. Blum
*Assistant Examiner*—Bernarr Earl Gregory
*Attorney, Agent, or Firm*—Antonelli, Terry & Wands

[57] ABSTRACT

In a multi-window system for setting a plurality of windows on the screen for independent display in each window, a novel display control method is disclosed in which a visible region of a given window is determined from the positions and overlapped relations between the windows on the display screen, and display data is selectively applied to the visible region. The visible region is checked for crossing between an object window and another window making up a reference window on the screen, and if they cross each other, the object window is divided into subregions, while the subregion not overlapped with the reference window is regarded as a new object region, which is collated with another reference window and subdivided. This process of collation and division is repeated. A display output is thus applied sequentially to the subregions which are found to be a visible region.

23 Claims, 16 Drawing Sheets

DISPLAY CONTROL METHOD FOR MULTI-WINDOW SYSTEM

BACKGROUND OF THE INVENTION

1. Field of the Invention

This invention relates to a method of controlling a display screen of a terminal unit of a data processing system, or more in particular, to a display control method for a multi-window system in which a plurality of rectangular display regions called windows are set in a display screen for independent data display in each window.

2. Description of the Prior Art

In a data processing terminal having a display unit, a retangular region called a "window" is set on the display screen, and data representing such as a document and read-out from a data file unit is displayed in this window. By key input operation while referring to this window another document is displayed in another region on the display screen. In what is called a multi-window system with a plurality of windows set on a single display screen, the windows are set in partially overlapped relationship with each other. By shifting the window display position or changing the order in preference of display, the display in a given window which has been initially hidden in part behind another window can be made wholely visible.

In the multi-window system, the respective windows set on the display screen correspond to logical or virtual display screens set on a memory which is referred to by a data processing system. Data stored in a part of this virtual screen is extracted, and developed as a bit map in a predetermined region on a frame memory corresponding to an actual display screen so as to be read-out as the contents to be displayed in the window.

Data representing the position and size of each window on the actual screen and the correspondence between the window and an extraction region on the virtual screen are registered in a specific area alloted to that window on a window control table, so that the operator can, by inputting a screen operation command into the data processing system, change and control the contents of the display in any desired window on the display screen by reference to the window control table.

Assume, for example, that the operator designates a specific one window by cursor and gives a command to shift this window to another position on the screen designated by cursor. On the window control table, the positional data of the particular window is rewritten and the contents of the frame memory are changed, thereby shifting the window position on the display screen. When a window is specified and a command to change the size thereof is given, on the other hand, the window size data on the window control table is rewritten, and the contents of the frame memory are changed so that a window of a different size appears on the display screen. Further, if a command is given to scroll the contents of display in a window, the position of a partial region on the virtual screen from which the data to be displayed is extracted is shifted so thst an image corresponding to the shifted region is displayed in the window.

In conventional multi-window systems, the position of a window is changed in such a manner that after the original window is cancelled from the screen, data is again extracted from a partial region on the virtual memory corresponding to the new window, and developed as a bit map at the new window position or the frame memory. In changing the window size, too, data is extracted from a partial region on the virtual memory corresponding to a new window size and developed as a bit map on the frame memory. This is also the case with the scrolling process, in which all the data required for display after scrolling are extracted from the virtual screen and developed as a bit map on the frame memory. The process of developing display data into a bit map such as converting data stored in the form of character code on the virtual screen into the form of character font, however, takes considerable time, and therefore a conventional method in which all the contents to be newly displayed must be developed into a bit map has a problem that it cannot rapidly replace the contents on the display screen.

In a multi-window system where a plurality of windows are set in a partially overlapped relationship with each other on the display screen, on the other hand, the data for a window lower in display order extracted from the virtual screen and supplied to the frame memory must exclude those data corresponding to the invisible part thereof overlapped with another window higher in display order. For the purpose of such partial display or non-display in each window as mentioned above, Japanese Patent Publication No. JP-A-59-102284 (1984) discloses a control system in which each window is divided into a plurality of rectangular subregions along the sides of other windows overlapped therewith as dividing lines, the data representing the position and size of each subregion together with the data discriminating each subregion "visual" (displayable) or "non-visual" (non-displayable) are stored in a visible region control table, and display data are applied only to the displayable subregions.

In the conventional multi-window systems, the above-mentioned data set on the display screen for visible and non-visible subregions on each of all the windows are always registered in the visible region control table, and in the case of a change in the display order or positional relationship of the windows or addition of another window on the screen, the data in the visible region control table are updated in accordance with the new arrangement in display of the display screen, thus making it possible to change the display of any selected window immediately by referring to the control table. With the complication of superimposition of windows on the display screen, however, windows are much divided into smaller subregions, resulting in that the conventional methods in which the data for visible subregions of all the windows must be always stored require a large memory capacity of the visible region control table, as well as a problem of an increased processing time for updating the data of the table.

SUMMARY OF THE INVENTION

An object of the present invention is to provide a display control method for a multi-window system which allows to use a reduced memory capacity for the control data necessary for discriminating visible and non-visible regions in each of the windows set on the display screen.

Another object of the present invention is to provide a display control method for a multi-window system in which the display arrangement of the display screen can be changed at high speed.

In order to achieve the above-mentioned objects, there is provided according to the present invention a display control method in which the visible region of an object window of which the content of display are required to be changed, is calculated on the basis of current relative positions of the windows on the display screen, and display data is applied to the visible region thus determined. For calculation of the visible region, the object window is collated with other windows (reference windows) sequentially, and if the object window is overlapped with one of the reference windows, it is divided into a plurality of rectangular subregions, of which those subregions which are not overlapped with the one reference window are selected as new rectangular regions to be divided, and each of the new regions is collated with other reference windows, sequentially, and repeating such sequential subdivision of the rectangular regions.

Specifically, the present invention provides a display control method for a multi-window system comprising a display screen in which a plurality of rectangular windows are set, first memory means for storing display data correspondingly to positions to be displayed on the display screen, second memory means for storing a plurality of display data for virtual screens corresponding to the windows, respectively, each window displaying data contained in a partial region of the corresponding virtual screen, third memory means for storing definition data representing the correspondency between position data of each window on the display screen and the virtual screen, and control means for rewriting a part of the display data stored in the first memory means, the display control method comprising the first step of collating an object window designated as an object of display control with a plurality of other windows selected sequentially as reference windows on the display screen, on the basis of the positional data stored in the third memory means, and if the object window crosses one of the reference windows, dividing the object window into subregions overlapped with the reference window and at least one rectangular non-overlapped subregion along the boundaries with the overlapped subregions as dividing lines; the second step of collating the non-overlapped subregion thus obtained as a dividing object rectangle region with another reference window and if the object rectangle region crosses the reference window, dividing the object rectangle region into subregions overlapped with the another reference window and at least one rectangular non-overlapped subregion, and repeatedly applying the collation and the division into subregions to a newly obtained non-overlapped subregion, as a new dividing object rectangular region, until no reference window to be collated with remains, and the third step of rewriting a part of the display data in the first memory means in accordance with the result of division of the object rectangular region, thereby changing the contents of display in the visible region included in the object window on the display screen.

In the display control method according to the present invention in which a visible region in a window is calculated as required, the capacity of memory area in the visible region control table is greatly reduced as compared with the conventional system. Assume that a window on the display screen is designated, and an operator takes care of data input and output with respect to this window. The definition data for the visible region determined by sequential division of a rectangular region is stored in the visible region control table and utilized for subsequent display control. When the control object is changed from one to another window, this definition data is kept stored if the visible region control table has a sufficient storage capacity. If no area remains for storing new definition data for a visible region determined for another window, however, the old definition data is delated and the delated definition data will be again calculated when required.

In the present invention, the definition data for a visible region are not always stored in the control table, but may be used provisionally for the purpose of change of the display order or deletion of a given window.

The foregoing and other objects, advantages, manner of operation and novel features of the present invention will be understood from the following detailed description when read in connection with the accompanying drawings.

DESCRIPTION OF THE PREFERRED EMBODIMENTS

Figure 1:
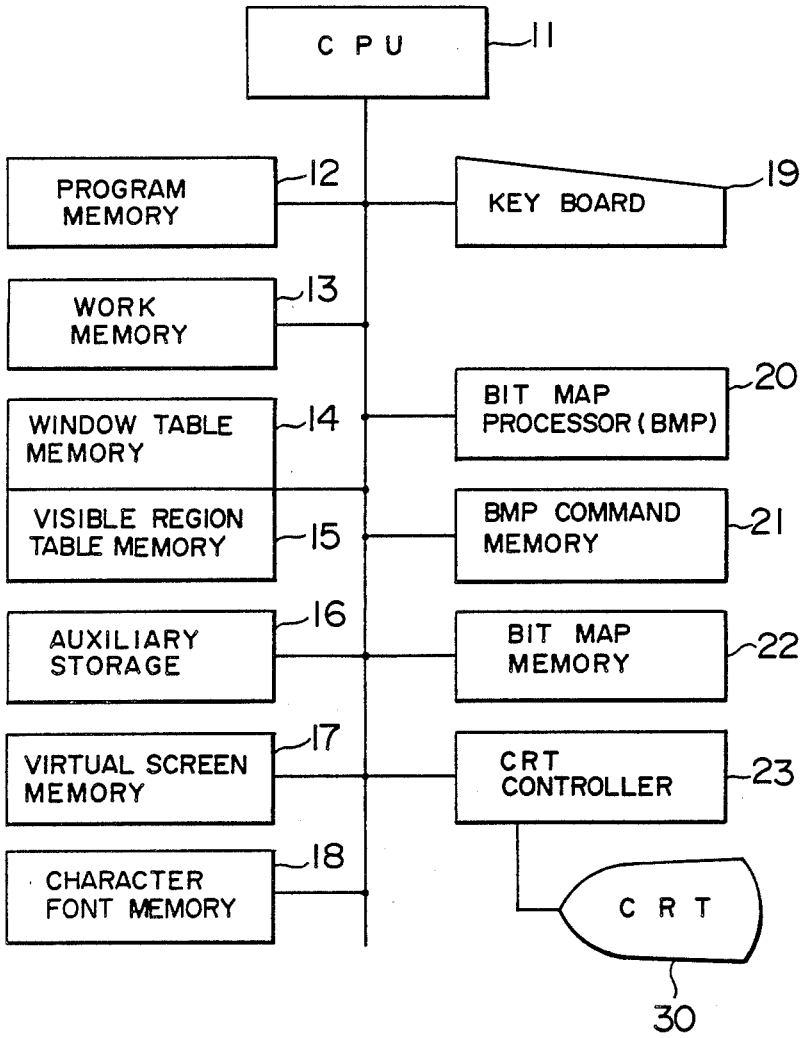
FIG. 1 is a block diagram showing the configuration of a multi-window system embodying the present invention.

FIG. 1 is a block diagram showing a general configuration of terminal device for a multi-window system according to the present invention. In FIG. 1, reference numeral 11 designates a data processing unit (CPU) for controlling the general operation of the terminal device, numeral 12 a memory for storing a program executed by the CPU, numeral 13 a work memory for temporarily storing the data generated in the process of execution of the program, numeral 14 a memory for storing the table data for window control, numeral 15 a memory for storing the table data for controlling the visible subregion in a window, numeral 16 an auxiliary memory for storing file data such as document data, and numeral 17 a memory for storing the data of a virtual screen corresponding to each window, which are read out of the auxiliary memory 16. Numeral 18 designates a character font memory for storing a character font corresponding to a character code, numeral 19 a keyboard for entering the data and various commands, numeral 20 a bit map processor (BMP) for developing the display data as a bit map on a bit map memory 22 (frame memory), numeral 21 a memory for storing various commands for operating the BMP 20 and numeral 23 a CRT controller for reading the contents of the frame memory 22 sequentially and applying the same to CRT 30.

Figure 2:
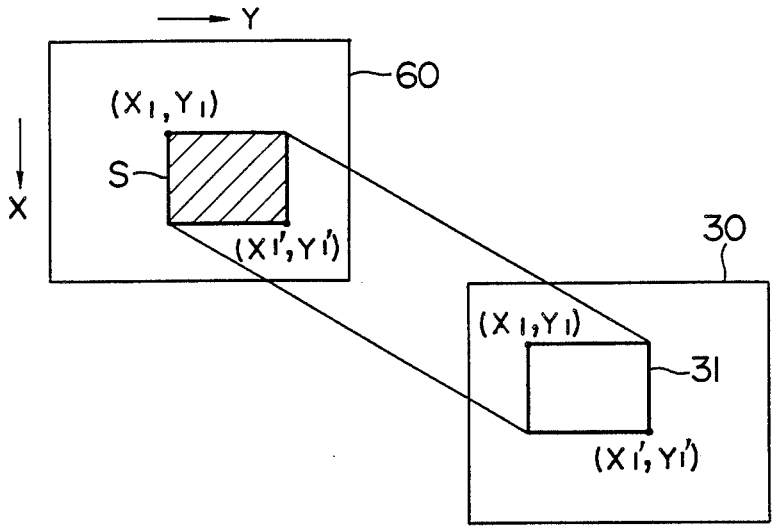
FIG. 2 is a diagram for explaining the relationship between a window set on the display screen and a partial region of the virtual screen displayed on the window.

FIG. 2 shows the relationship between a virtual screen 60 provided in the memory 17 and a window 31 set on a display screen (actual screen) 30. In this example, the position and size of the window is expressed by the X-Y coordinate ($X_1$, $Y_1$) of the starting point (upper left corner) and the X-Y coordinate ($X_1'$, $Y_1'$) of ending point (lower right corner) of the window rectangle. The values of X and Y coordinates increase in downward and rightward directions, respectively. The virtual screen 60 has the same size as the actual screen 30, and the data positioned in a region S occupying a part thereof is displayed on the window 31. The virtual screen 60, however, may be larger than the actual screen 30. The position and size cf the partial region S, like the window 31, is expressed by the X-Y coordinate ($x_1$, $y_1$) and ($x_1'$, $y_1'$) of the starting and ending points respectively. The correspondency between the window 31 and the partial region S is stored in the window control table 140 described later with reference to FIG. 5A.

Figure 3:
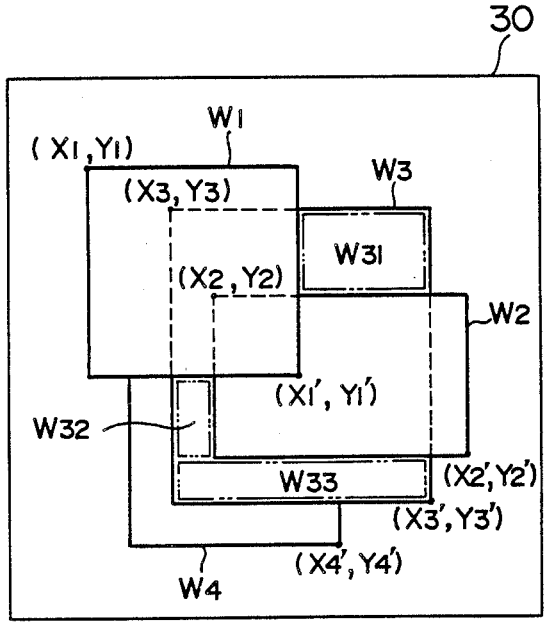
FIG. 3 is a diagram for explaining the visible region in a window overlapped with another window.

FIG. 3 shows a display screen of a multi-window system in which a plurality of windows $W_1$, $W_2$, $W_3$, $W_4$ are displayed overlapped on the display screen 30. In the illustrated positional relationship, the display order of the window $W_1$ is highest, the display order of the window $W_4$ is lowest and the display order of the window $W_2$ is lower than that of the window $W_1$ but higher than that of the window $W_3$. Assume that the order in display of the windows is determined such that the window $W_3$ is positioned under the windows $W_1$ and $W_2$, and only a part thereof including subregions $w_{31}$, $w_{32}$ and $w_{33}$ are visible as shown in FIG. 3. According to the present invention, these visible subregions $w_{31}$ to $w_{33}$ in the window $w_3$ are determined for display control in the manner mentioned below.

First, the object window $w_3$ to be checked for division is collated with the window $W_1$ (reference window) having the highest display order to see whether these two windows cross each other. In the case where the coordinates of the starting and ending points of the object window $W_3$ are given as ($X_3$, $Y_3$), ($X_3'$, $Y_3'$) and those of the reference window $W_1$ as ($X_1$, $Y_1$), ($X_1'$, $Y_1'$) respectively, the following relationship holds if the windows $W_1$ and $W_3$ cross and the overlapped with each other.

$$(X_3<X_1') \text{ and } (Y_3<Y_1'), \text{ and } (X_1<X_3') \text{ and } (Y_1<Y_3')$$

Figure 4A:
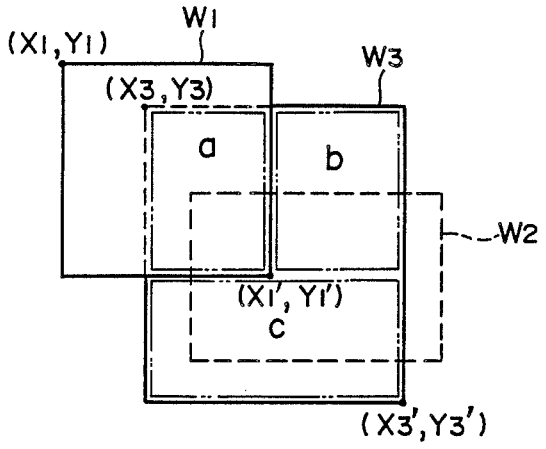
FIGS. 4A and 4B are diagrams for explaining a method of sequential division of the display region for calculating the visible region according to the present invention.

In the case where there is any overlapped portion, the window $W_3$ is divided into a plurality of subregions by a dividing line along any of the upper, lower, left and right sides of the window $W_1$ located within the window $W_3$. In an example shown in FIG. 4A, the window $W_3$ is divided into two parts by the lower side (coordinate $Y_1'$) of the window $W_1$, and the upper part is further halved by the right side (coordinate $X_1'$) of the window $W_1$, thus obtaining three subregions a, b and c. Of these subregions, the subregion a is completely covered by the window $W_1$ and therefore becomes an invisible region, while the subregions b and c remain as visible regions (if the window $W_2$ is cancelled).

Figure 4B:
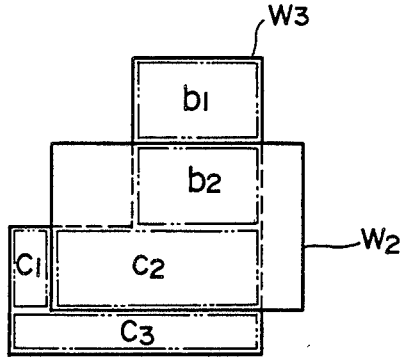

According to the present invention, the subregions b and c which have remained as invisible regions (non-overlapped regions) are taken as object subregions, and checked with respect to the window $W_2$ having the second highest display order within the windows whose display orders are higher than the window $W_3$ as a reference window by repeating a similar dividing process to that applied to the window 3 by using the window $W_1$ as a reference window. As a result, as shown in FIG. 4B, the subregion b is further divided into $b_1$ and $b_2$, and the subregion c into $c_1$, $c_2$ and $c_3$, so that the three subregions $b_1$, $c_1$ and $c_2$ except for $b_2$ and $c_2$, which are completely covered by the window $w_2$, remain as visible subregions. If there is any other window having higher display order than the window $W_3$, the subregions $b_1$, $c_1$ and $c_3$ are further checked with respect to the windows $W_3$ and divided into visible and ono-visible subregions. In the case under consideration, the subregions $b_1$, $c_1$ and $c_3$ make up the final visible subregions corresponding to the visible subregions $w_{31}$, $w_{32}$ and $w_{33}$ respectively in FIG. 3.

Figure 5A:
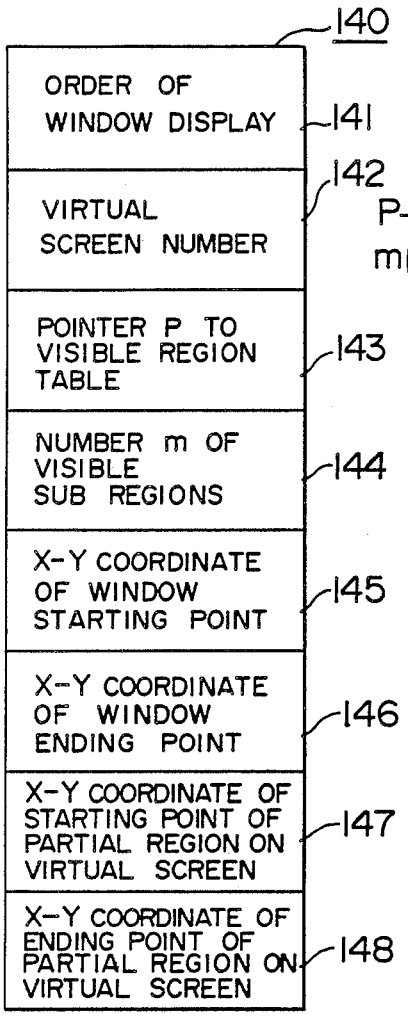
FIG. 5A shows a configuration of a window control table.

FIG. 5A shows a construction of the window control table 140 formed in the memory 14. Such window control table 140 are prepared in correspondence with the windows $W_1$ to $W_4$ set on the display screen respectively. Each table includes a display order 141 of that window, assuming that each window is identified by its display order, an identification number 142 of the virtual screen corresponding to the window, a pointer 143 for the visible region table described below, the number 144 of visible subregions, X-Y coordinate 145 of the starting point of the window, the X-Y coordinate 146 of the ending point of the window, the X-Y coordinate of the starting point of a partial region extracted from the virtual screen, and the X-Y coordinate 148 of the ending point of the same partial region.

Figure 5B:
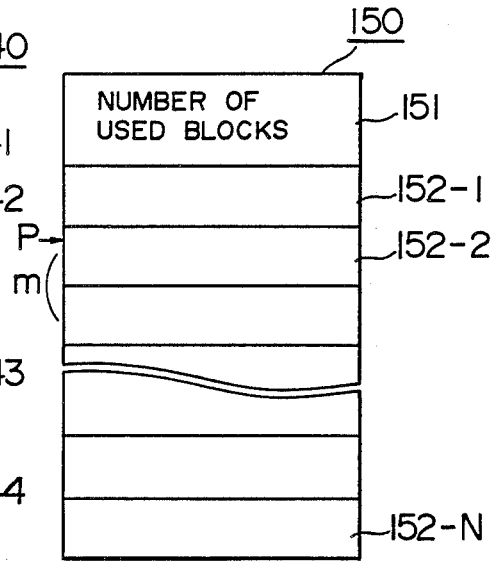
FIG. 5B shows a configuration of a visible region control table.
Figure 5C:
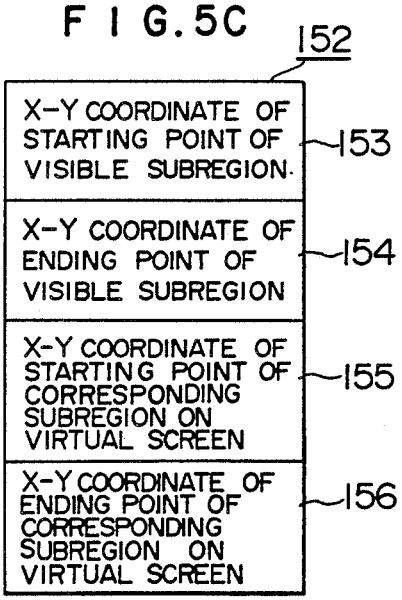
FIG. 5C shows a detailed view of data blocks of the visible region control table.

FIG. 5B shows the constricution of a visible region table 150 formed on the memory 15, This table includes a number N of blocks 152-1 to 152-N and an area 151 indicating the occupied blocks in the table. The above-mentioned pointer 143 points to the leading position P of continued m blocks whose number m is stored in the area 144 in FIG. 5A. Each block, as shown in FIG. 5C, includes the X-Y coordinates 153 and 154 of the starting and ending points respectively of a visible subregion on the display screen and the X-Y coordinates 155 and 156 of the starting and ending points of the subregion on the virtual screen corresponding to the visible subregion.

In the conventional multi-window systems, the visible region table 150 is provided with a sufficient number of blocks to store all the definition data of the visible subregions of each window even in the case there an allowable maximum number of windows are set on the display screen. According to the present invention, in comparison, the number N of the blocks of the visible region table 150 is greatly reduced. Once visible subregions are determined by the steps mentioned in FIGS. 4A and 4B for display control, the definition data for these visible subregions are registered in the table 150. In the case where the table 150 already has much definition data registered therewith and has no sufficient remaining blocks for registering all the definition data of the newly-calculated visible subregions, a part or whole of the already-registered data is deleted, and definition data of the new visible subregions are registered in its place. At the same time, the pointer 143 and the number 144 are cleared from the control table 140 for the window corresponding to the visible subregions deleted from the table 150. As to the window for which the pointer 143 is cleared, its visible subregion will be determined by the sequential region-dividing process as mentioned-above on the basis of positional relationship with other windows, when it is required to again take up that window as an object window to be subjected to display control and then registered with the table 150 followed by the updating of the frame memory 22 with reference to this table 150. As to a window which is not an object to be subjected to display control, on the other hand, the contents of the corresponding region on the frame memory remain unchanged, and therefore the absence of the definition data of the visible subregions in the table 150 poses no problem.

Figure 6:
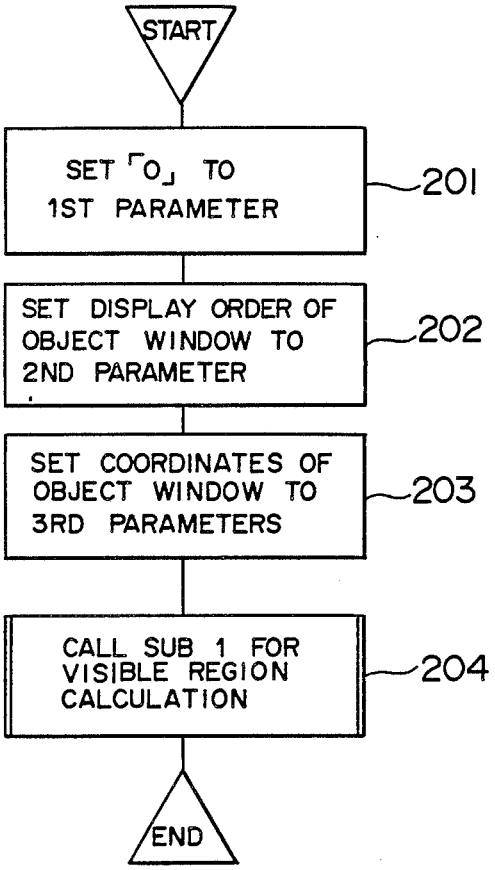
FIG. 6 is a program flowchart for executing the sequential division of a display region.

Assume that a window $W_O$ on the display screen is designated as an object window, and the display for this window is to be changed. If the pointer 143 is recorded on the window control table 140, the visible region table 150 is referred to according to this pointer, and on the basis of the definition data of the visitle subregion registered therein, the frame memory 22 is partially rewritten. If the pointer 143 fails to point to the table 150, by contrast, the program shown in the flowchart of FIG. 6 is executed in such a manner that step 201 thereof set the initial value "0" at the first parameter designating the reference window generally represented by the display order thereof, step 202 sets a second parameter as the display order of the object window $W_0$, step 203 sets the values of the X-Y coordinates 145, 146 of the window W0 as third parameters defining the object rectangle, and step 204 calls the subroutine (SUB1) for calculating the visible region with these parameters as arguments.

Figure 7:
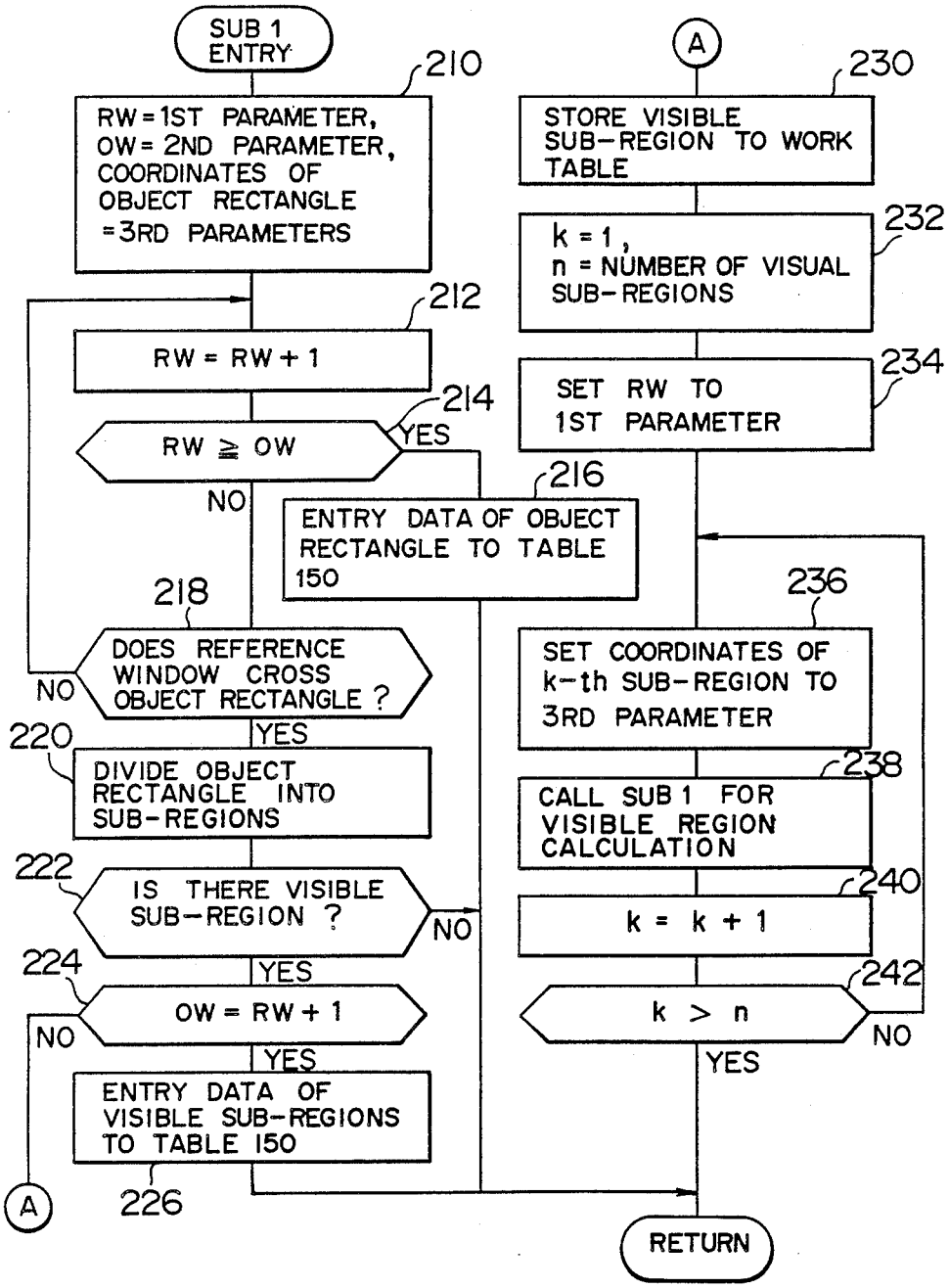
FIG. 7 is a flowchart showing an embodiment of a subroutine constructing the program of FIG. 6.

In the subroutine SUB1, as shown in FIG. 7, step 210 sets the value of the first parameter to parameter RW, the second parameter to parameter OW, and the third parameter to the coordinate data of the object rectangle which may be an object window or subregion. Step 212 increments the value of RW by one, and step 214 compares the value of RW with OW. If RW is smaller than OW, that is, if the display order of the reference window is higher than that of the object rectangle window, the process proceeds to step 218 to decide whether the reference window crosses the object rectangle. Assume that the coordinates of the starting and ending points of the object rectangle are given as (X01, X02), (X02, Y02), and those of the reference window as (XR1, YR1), (XR2, YR2), then if the relations hold that $$(X01 < XR2) \text{ and } (Y01 < YR2), \text{ and } (XR1 < X02) \text{ and } (YR1 < Y02)$$

the object rectangle crosses the reference window. In this case, process is passed to step 220, and the object rectangle is subdivided into a plurality of subregions in the manner mentioned with reference to FIGS. 4A and 4B. If the object rectangle does not cross the reference window, on the other hand, the process is returned to the step 212 where the reference window is replaced by the one having the next higher display order followed by the checking whether it crosses the object rectangle. If RW is found equal to OW at step 214, it is decided that there is no other window overlapped with the object rectangle, and step 216 registers the definition data of the whole rectangle as a display region in the visible region table 150, followed by the returning to the original program.

When the step for dividing into subregions ends at step 220, step 222 checks whether they include any visible subregion. If they include any one, step 224 checks to see whether the reference window just used is located immediately above the object rectangle. If so, the visible subregion currently determined is considered to be true, and step 226 registers the visible subregion in the visible region table 150.

In the event that the reference window is not located immediately above the object rectangle, on the other hand, any visible subregion currently determined is required to be checked to see whether it crosses another window of higher display order. Such uncertain visible subregions are stored in a work table provided to the memory 13 at step 230, and they are selected, sequentially one by one, as an object rectangle to be subjected to collation with the remaining reference windows as mentioned below. First, step 232 sets the initial value "1" at the parameter k which designates one subregion to be taken up from the work table, and sets the number of the subregions at the parameter n. Step 234 sets the present value of at the first parameter by which the reference window is designated, followed by step 236 where the definition data of the k-th subregion on the work table is set at the third parameter. The second parameter set by step 202 is used as it is. With these first to third parameters as arguments, the subroutine SUB1 is called. As a result, the k-th subregion on the work table is collated with the (RW+1)th and subsequent windcws, sequestially. After step 238, step 240 increases tte value of the parameter k by one, and steps 236 to 249 are repeated until the value k exceeds n. When the subroutine SUB1 is executed repeatedly in this way, the subregion estimated as a display region in view of the positional relationship with the reference window of the highest display order is sequentially divided into smaller subregions on the basis of its positional relationship with other reference windows having higher display order than the object window, so that the definition data of finally determined visible subregion is registered in the visible region table 150.

Figure 8A:
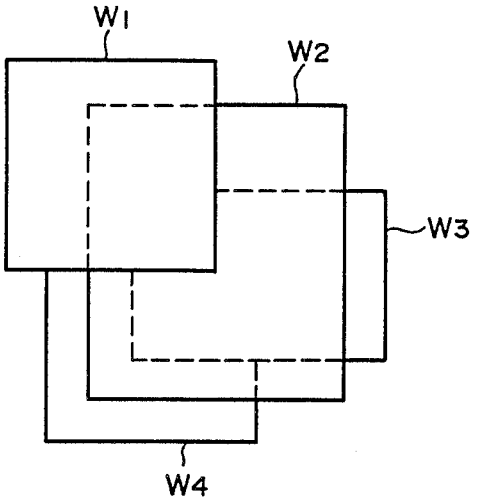
FIGS. 8A and 8B are diagrams for explaining the display screen from which a window is deleted according to a second embodiment of the present invention.
Figure 8B:
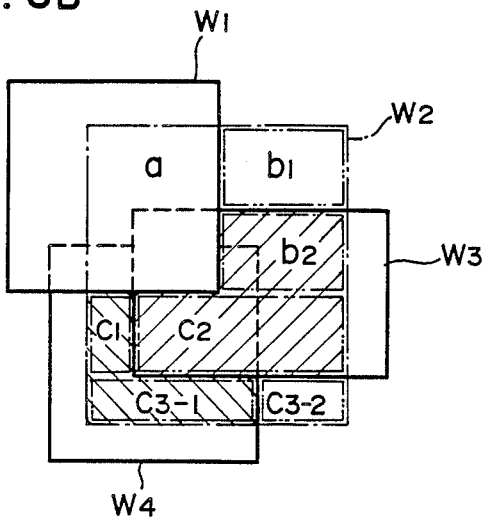

FIGS. 8A to 10 show a second embodiment of the present invention. In this embodiment, four windows $W_1$, $W_2$, $W_3$ and $W_4$ are initially overlapped on the display screen 30 as shown in FIG. 8A. If the second window $W_2$ is deleted from the screen, the display of the part that has initially been an non-visible region overlapped by the window $W_2$ must be restored. In this case, according to the invention, the window $W_2$ to be deleted is used as an object rectangle, and the sequential collation process with other windows (reference windows) is applied to the window $W_2$ so as to sequentially divide it into subregions. If a reference window is higher in display order than the object window (rectangle), any subregion thus obtained which is not overlapped with the reference window is stored in the work table, and used as the next object rectangle, which is sequentially divided in the same manner as in the first embodiment. In this second embodiment, all the windows having lower display order than the object window are also used as reference windows. Display is restored in succession in the subregions which are initially overapped completely with the reference windows of lower display order. Any subregion which is not overlapped with any of the reference windows of lower display order is deleted from the screen, and a blank is left there without any display. According to this control method, the second window $W_2$ in FIG. 8A is subdivided into a, $b_1$, $b_2$, $c_1$, $c_2$, $c_{3-1}$, and $c_{3-2}$, as shown in FIG. 8B, and the contents of the window $W_3$ are displayed in the subregions $b_2$ and $c_2$, and those of the window $W_4$ in the subregions $c_1$ and $c_{3-1}$. The subregions $b_1$ and $c_{3-2}$ that are not overlapped with any other windows are cleared.

Figure 9:
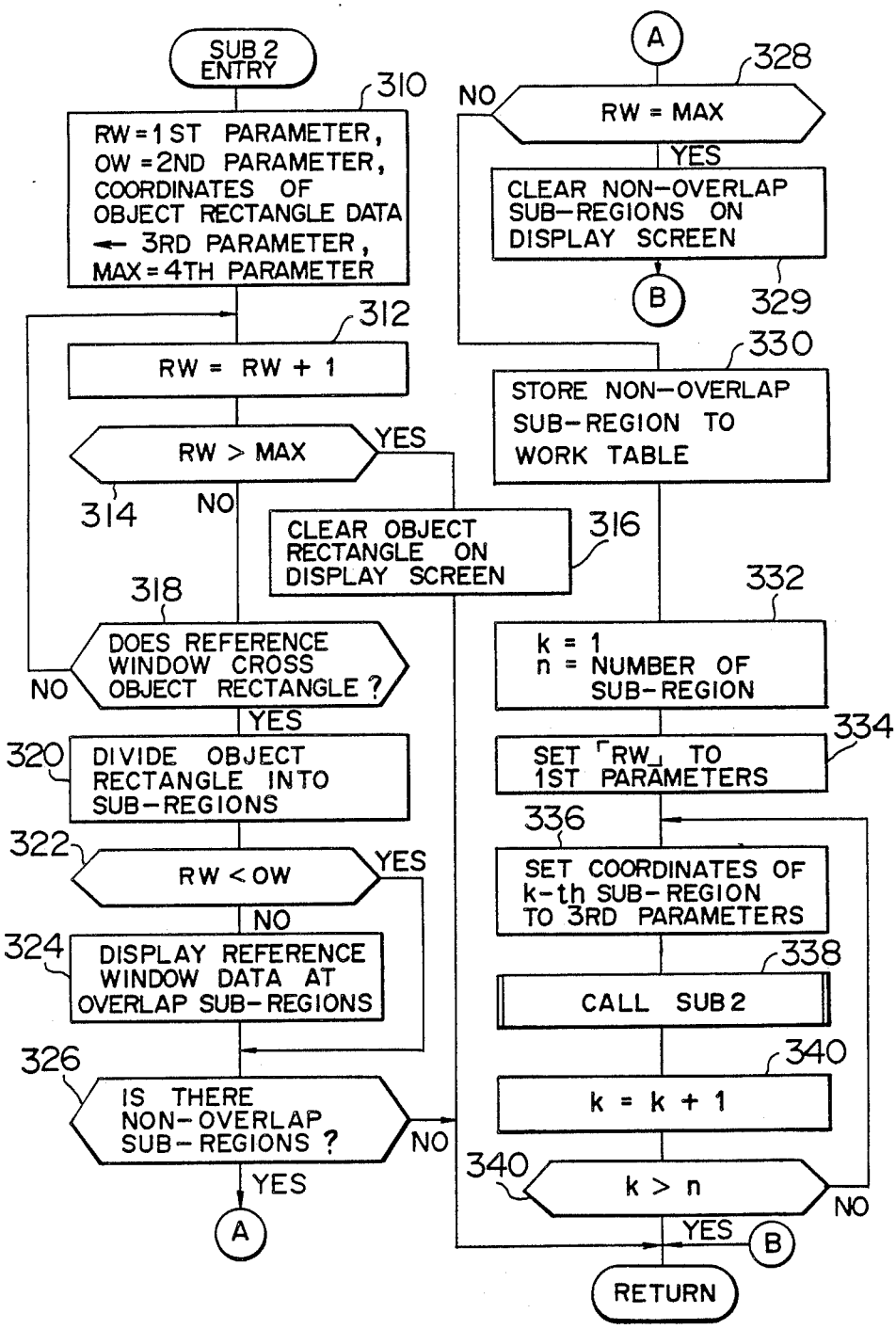
FIG. 9 is a flowchart of a program for realizing the second embodiment.

FIG. 9 shows a flowchart for the subroutine SUB1 for realizing the second embodiment mentioned above. This subroutine has the number of windows on the display screen as the fourth parameter in addition to the first to third parameters described above, and is called with these parameters as arguments.

At the first step 310, the values of the above-mentioned arguments are set at the respective parameters in the subroutine, followed by step 312 for incrementing the value of display order RW by +1 by which the reference window to be used is designated. Step 314 compares the value RW with the number MAX of the windows. If RW does not exceed MAX, step 318 decides whether the object rectangle crosses the RW-th reference window, and if not, the process is returned to step 312. The decision on the crossing is made in the same manner as in step 218 of SUB1. If RW is found larger than MAX at step 314, by contrast, it means that the object rectangle does not cross any window, and therefore step 316 clears the contents of display of the object region on the display screen, thus terminating this subroutine.

If step 318 decides that the object rectangle crosses the reference window, step 320 divides the object rectangle into a plurality of subregions. Step 322 compares the display order RW of the reference window with the display order OW of the object window, and if RW is found equal to or lower than OW, then the contents of the reference window are displayed in the subregion overlapped with the reference window (step 324). If RW is higher, on the other hand, there is no need to display. In the case where the subregions currently divided include a sutregion not overlapped with the reference window, the process is passed to step 328, while if there is no subregion rot overlapped with the reference window, the subroutine is ended.

If step 328 finds that the display order R of the reference window is equal to MAX as a result of comparison, step 329 clears these non-overlapped subregions on the display screen, thus ending this subroutine. If RW is not equal to MAX, by contrast, these non-overlapped subregions are required to be collated with other windows. Step 330 thus stores these subregions in the work table, followed by execution of steps 332 to 342. Steps 332 to 342 are the same as steps 232 to 242 in FIG. 7 except that the subroutine called at step 338 is SUB2.

Figure 10A:
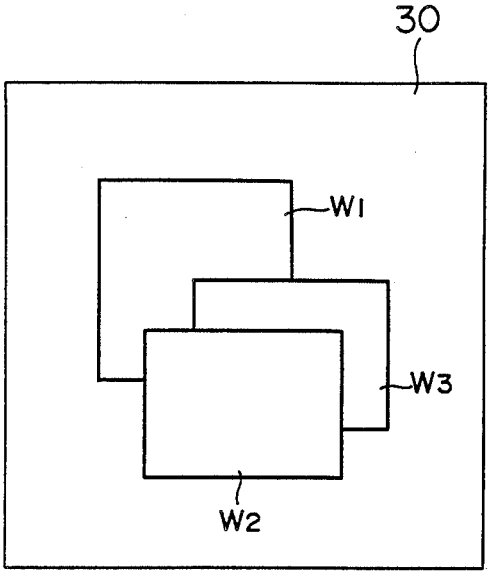
FIGS. 10A and 10B are diagrams for explaining the display screen in which the order in display of window is changed according to a third embodiment of the present invention.
Figure 10B:
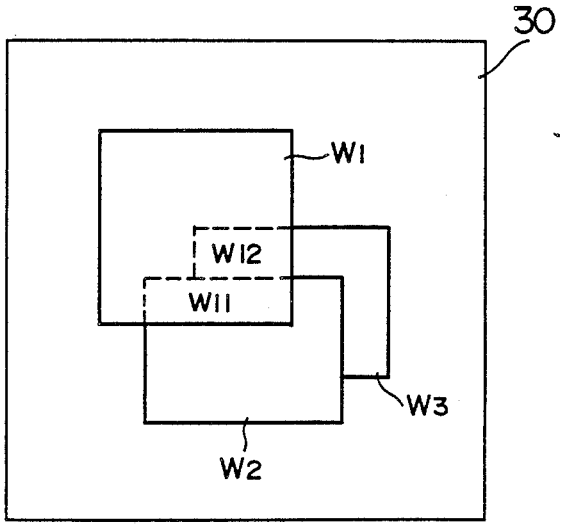
Figure 11:
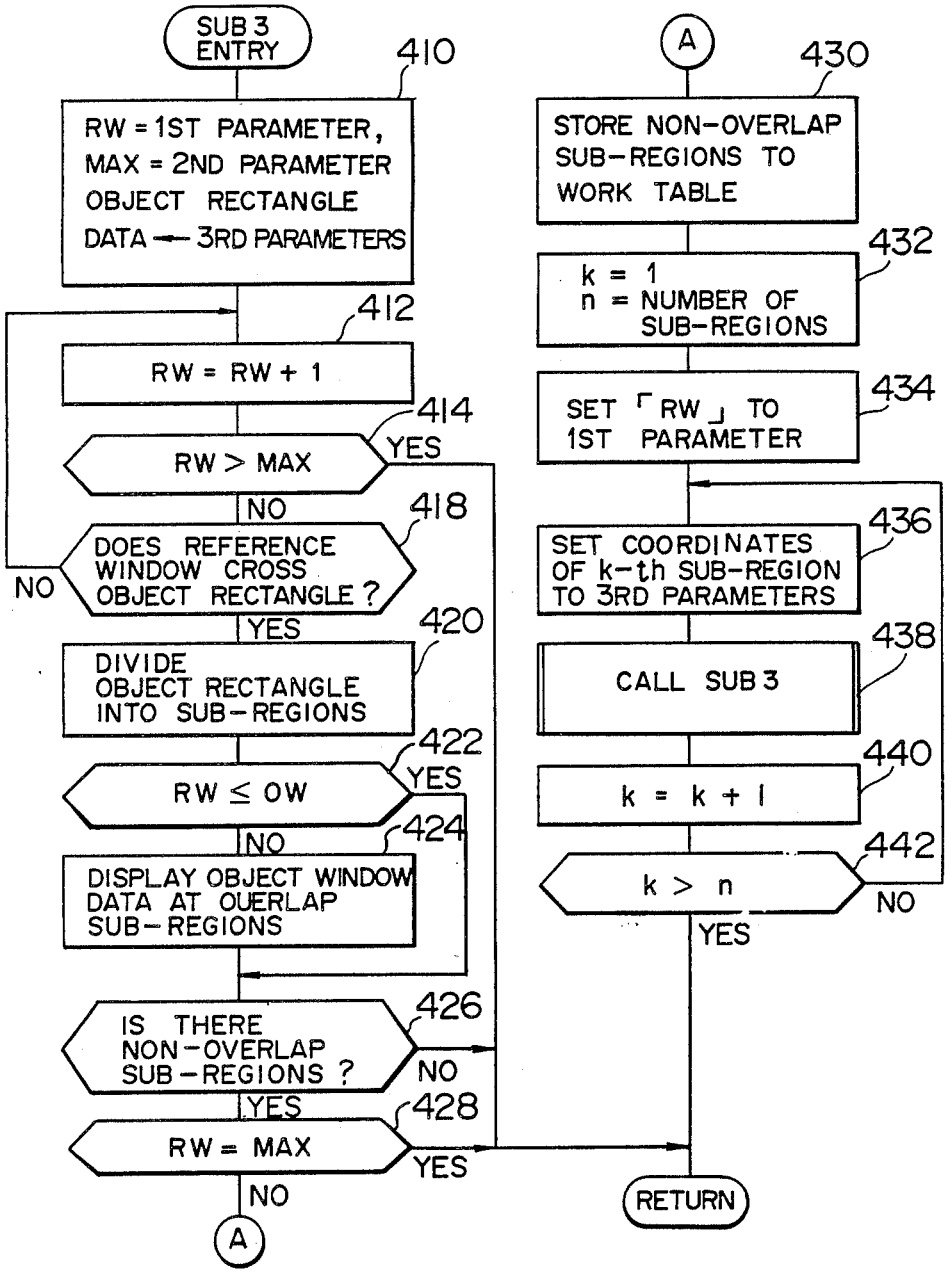
FIG. 11 is a flowchart of a program for realizing the third embodiment of the present invention.

A third embodiment of the present invention is shown in FIGS. 10A to 11. Assume that three windows $W_1$, $W_2$ and $W_3$ are initially displayed on the display screen as shown in FIG. 10A, and the display order of the window $W_1$ is to be changed from the lowest one as shown in FIG. 10A to a higher one as shown in FIG. 10B. The data of the window $W_1$ is required to be displayed in the subregions $w_{11}$ and $w_{12}$ that have so far been hidden behind the windows $w_2$ and $w_3$. Even in the case of change in display order such as this example, the processes for collation and division are performed by taking the window $W_1$ as an object rectangle and the windows $W_2$ and $W_3$ as reference windows, thereby to calculate the subregions $w_{11}$ and $w_{12}$ and change the display in these subregions.

FIG. 11 shows a flowchart of subroutine SUB3 for changing the display order mentioned above. In this subroutine, the initial value "0" is set at a first parameter indicating a reference window, and the new display order of the object window is called as a second parameter, the coordinate data of the object window or object rectangle as a third parameter, and the original display order of the object window as a fourth parameter.

The first step 410 of the subroutine SUB3 sets the value of the first parameter to the display order RW of the reference window, the second parameter to the display order OW of the object rectangle, the third parameter to the coordinate value of the rectangle to be divided, and the fourth parameter to the last reference value MAX. Step 412 increments the value RW by 1, and step 418 checks whether the object rectangle crosses the RW-th window (reference window) until RW exceeds MAX. When the value RW exceeds MAX, this subroutine ends. If the object rectangle crosses the reference window, step 420 divides the object rectangle into a plurality of subregions. Step 422 compares RW with OW, and if the former is larger (that is, lower in display order), the contents of the subregion overlapped with the reference window are replaced by the contents of the object window at step 424. Step 426 decides whether the subregions currently obtained include subregions not overlapped with the reference window, and if there is no non-overlapped region, this routine ends. If there is any non-overlapped region, by contrast, step 428 compares the display order RW of the reference window with MAX, and if they are equal to each other, this routine is ended. If RW is not equal to MAX, the process proceeds to step 430. Step 430 stores the subregions not overlapped with the reference window in the work table. Steps 432 to 442 divide these subregions based on positional relationship with the other window in the same manner as in the first and second embodiments.

In the case of FIG. 11, the display order of the object window is changed higher. If the display order is to be changed lower, the second parameter is used as the original display order of the object window, and the fourth parameter as a new display order of the object window. In this case, step 424 in FIG. 11 is adapted to display the contents of the reference window in the overlapped subregions.

Figure 12A:
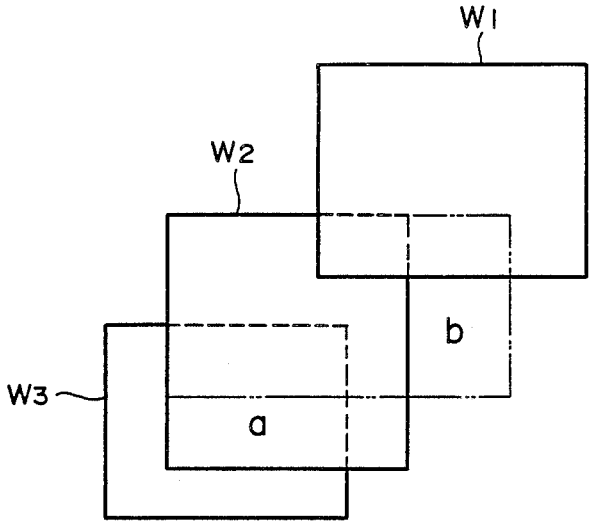
FIGS. 12A and 12B are diagrams for explaining the display screen in which the size of a window is changed according to a fourth embodiment of the present invention.
Figure 12B:
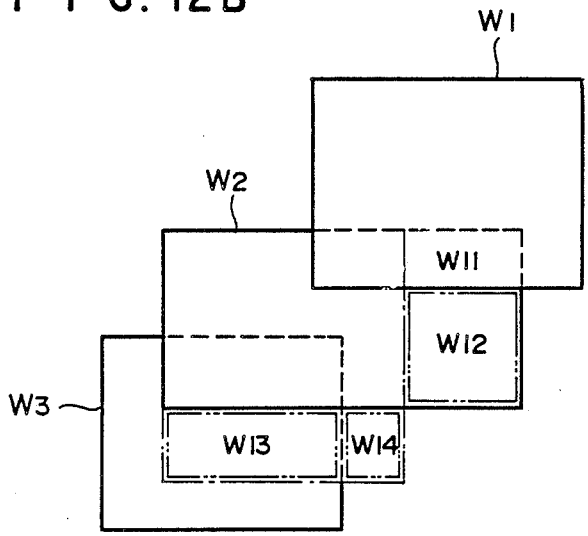
Figure 13:
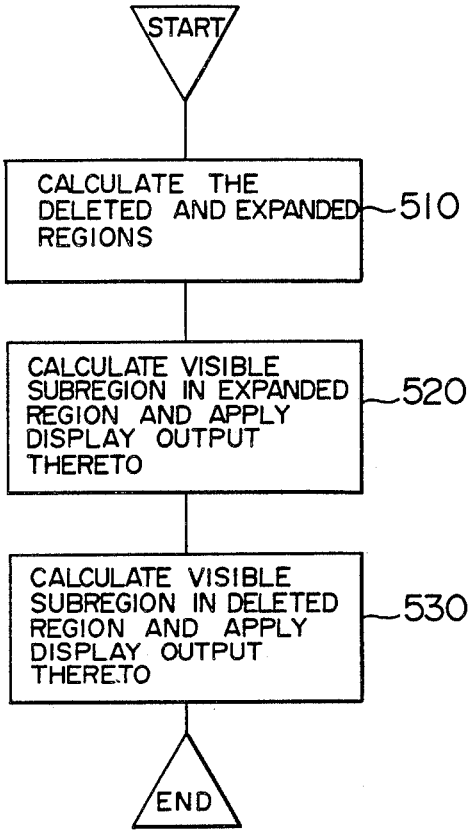
FIG. 13 is a flowchart for a program for realizing the fourth embodiment.

A fourth embodiment of the present invention is shown in FIGS. 12A to 13. In this embodiment, as in FIG. 12A, for example, the second window $W_2$ among the three windows $W_1$, $W_2$ and $W_3$ displayed in overlapped relations is used as an object window, whereby the partial region a on the lower side thereof is deleted, while the right side is expanded by the region b. In such a screen size change as this, according to the invention, the size data before and after the change of the object window are compared as shown in FIG. 13, thereby determining by calculation the deleted partial region a and the expanded partial region b (Step 510). As to the partial region b to be expanded, on the other hand, it is regarded as an object rectangle and sequentially divided into subregions in the manner shown with reference to the first embodiment, with the result that the display change is made by developing a bit map only for the visible subregions thereof (Step 520). Also, as for the region a to be deleted, it is regarded as an object rectangle, and sequentially divided in the manner shown in the second embodiment, whereby a partial screen is restored for the windows of lower display order (Step 530). As a result, as shown in FIG. 12B, the contents of the windows $W_2$ and $W_3$ are additionally displayed in the visible subregions $w_{12}$ and $w_{13}$ respectively.

Figure 14:
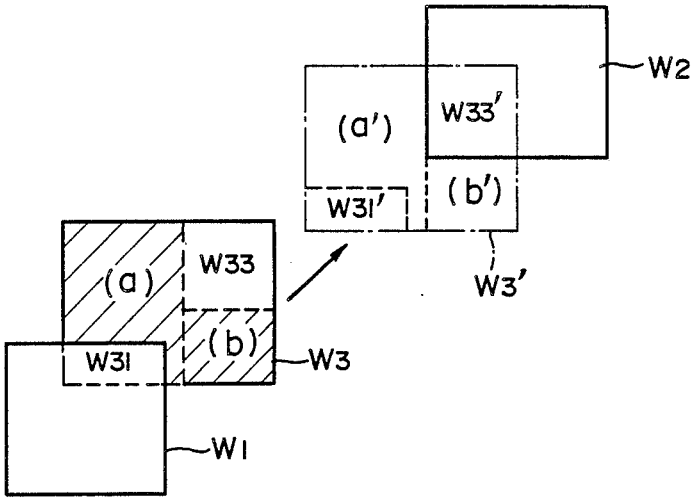
FIG. 14 is a diagram for explaining the display screen in which the position of a window is shifted according to a fifth embodiment of the present invention.

Now, a fifth embodiment of the invention will be described below. FIG. 14 shows the manner in which the window $W_3$ that has so far been located under the window $W_1$ among the three windows $W_1$, $W_2$ and $W_3$ displayed on the sreen is relocated to the position of $W_3'$ indicated by one-dot chain. In the window $W_3'$ after relocation, $W_{33}'$ indicates the parts hidden behind the window $W_2$ and $w_{31}'$ the part that has so far been hidden behind the window $W_1$.

Figure 15:
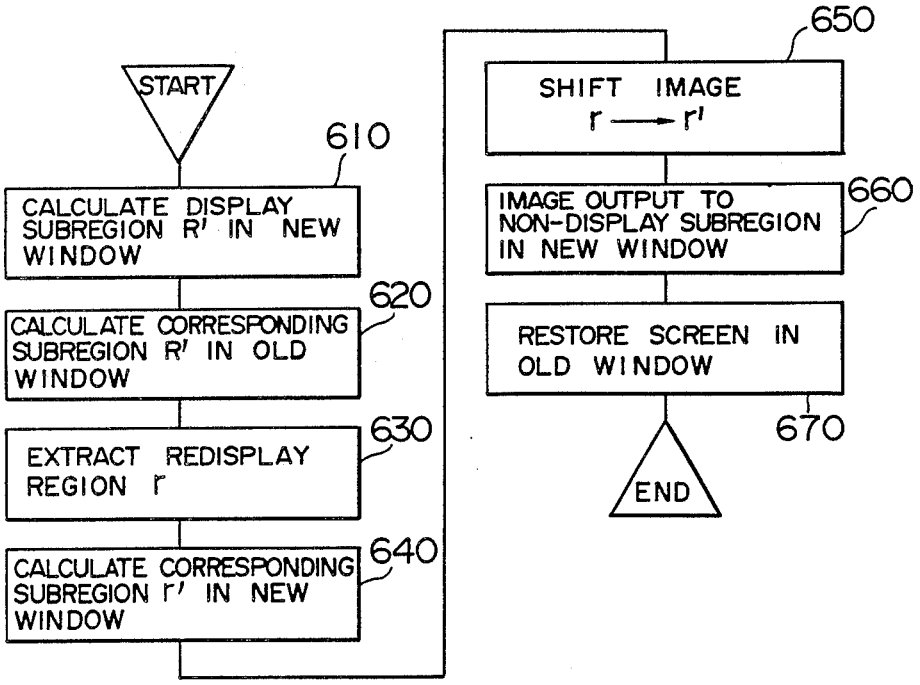
FIG. 15 is a flowchart of a program for realizing the fifth embodiment.

According to the present invention, the display control with this window shift is effected by the steps shown in FIG. 15.

First, step 610 checks whether the window $W_3'$ after relocation (shift) as an object rectangle crosses another window, and if it does, determines a visible subregion R' (=Subregion a'+Subregion b'). After that, step 620 determines the subregion R (=Subregion a+Subregion b) within the window ($W_3$) after relocation corresponding to the visible subregion R'. Step 630 checks whether the subregion R as an object rectangle crosses any other windows, and if so, determines the overlapped region $w_{31}$ and the redisplay region r (hatched region). Step 640 determines the region r' after relocation corresponding to the redisplay region r. Step 650 relocates the image data of the region r to the region r' on the frame memory. Step 660 determines the subregion $w_{31}'$ in the window $W_3'$ corresponding to the overlapped region $w_{31}'$ and by developing a bit map from the virtual screen, displays on the subregion $w_{31}$. Further, step 670 sequentially divides the screen region occupied by the window $W_3$ before relocation by taking it as an object rectangle and applying thereto the process as mentioned in the second embodiment thereby to restore the screen. If another window is located under the window $W_3$ in FIG. 14, a part hidden comes to appear on the screen at step 670.

As explained above, the display of the visible region of the window after relocation is effected by a combination of data shift from the old window on the frame memory and the bit map development on the virtual screen, so that the amount of data developed as a bit map is reduced thereby to increase the speed of display change.

A sixth embodiment of the present invention is shown in FIGS. 16 to 19. According to the embodiment under consideration, in what is called the scroll operation for shifting the visual field in a window, the overlapped relations of a visible region on a virtual screen before and after scroll are used to determine those display regions before scroll which become redisplay regions on the screen after scroll, and these redisplay subregions are displayed by shifting data on the frame memory, so that the data from the virtual screen are developed as a bit map only for the regions newly covered by the visual field, thus reducing the amount of data to be developed as a bit map.

Figure 16:
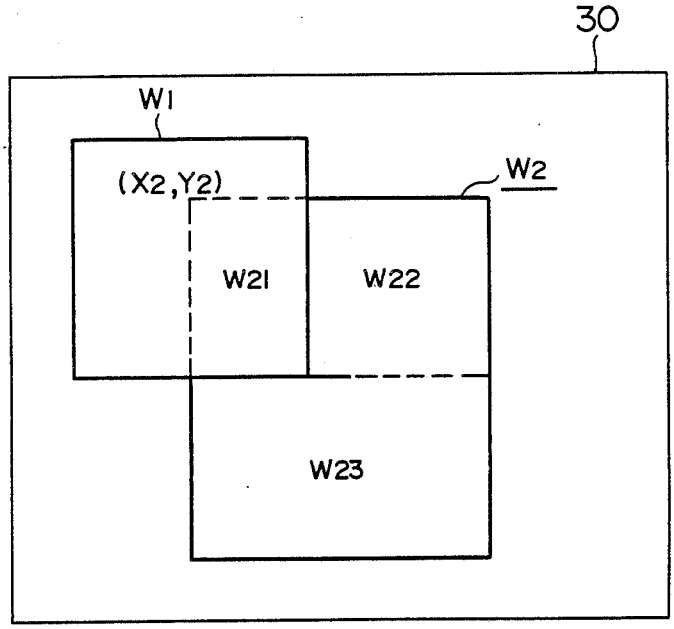
FIG. 16 is a diagram for explaining the display screen of which the display is scrolled according to a sixth embodiment of the present invention.

Now, assume that the contents of display of the window $W_2$ overlapped with the window $W_1$ on the display screen 30 are scrolled as shown in FIG. 16. The window $W_2$ divided into three subregions $w_{21}$, $w_{22}$ and $w_{23}$, of which $w_{22}$ and $w_{23}$ make up visible regions.

Figure 17:
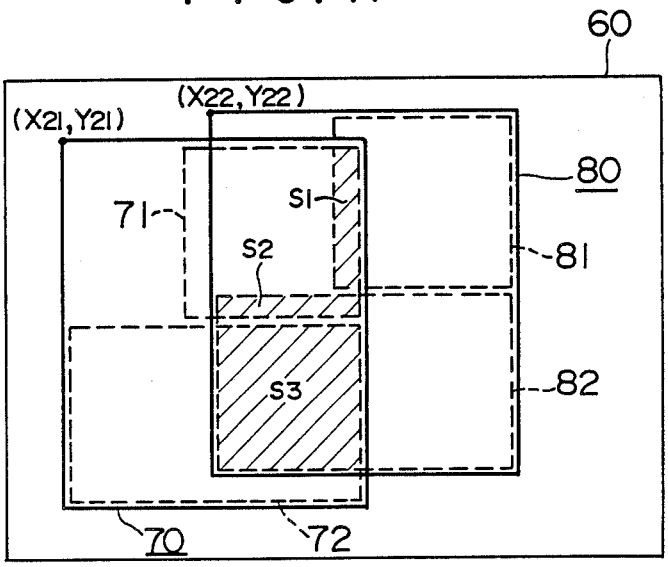
FIG. 17 is a diagram for explaining a virtual screen used in the sixth embodiment.
Figure 18:
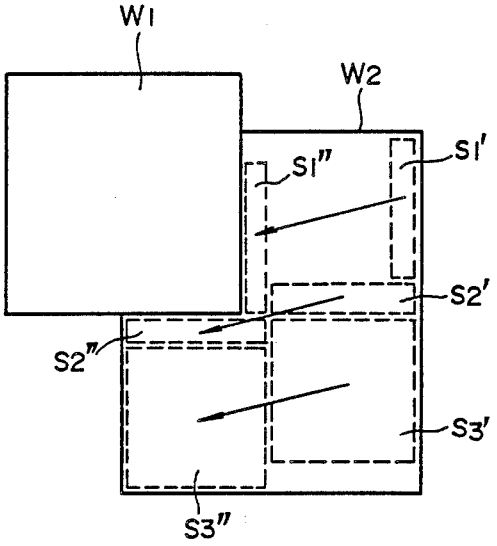
FIG. 18 is a diagram for explaining a redisplay region for data on the display screen according to the sixth embodiment.

FIG. 17 shows a virtual screen 60 corresponding to the window $W_2$. Numeral 70 designates a region corresponding to the window before scroll, and numeral 80 after scroll. In this example, the partial regions S1 and S2 in the virtual screen region 71 corresponding to the subregion $w_{22}$ remain at the left end of the subregion $w_{22}$ and the upper left corner of the subregion $w_{23}$ after scroll respectively. In similar manner, the partial region S3 of the virtual screen region 72 corresponding to the subregion $w_{23}$ is left at the lower left corner of the subregion $w_{23}$ after scroll. If these display regions S1, S2 and S3 are capable of being specified, therefore, a scroll screen may be obtained by shifting the contents of the redisplay regions S1', S2' and S3' to $S_1''$, $S_2''$ and $S_3''$ respectively on the frame memory as shown in FIG. 18 and by developing the data from the virtual screen as a bit map only for the other visible regions.

Figure 19:
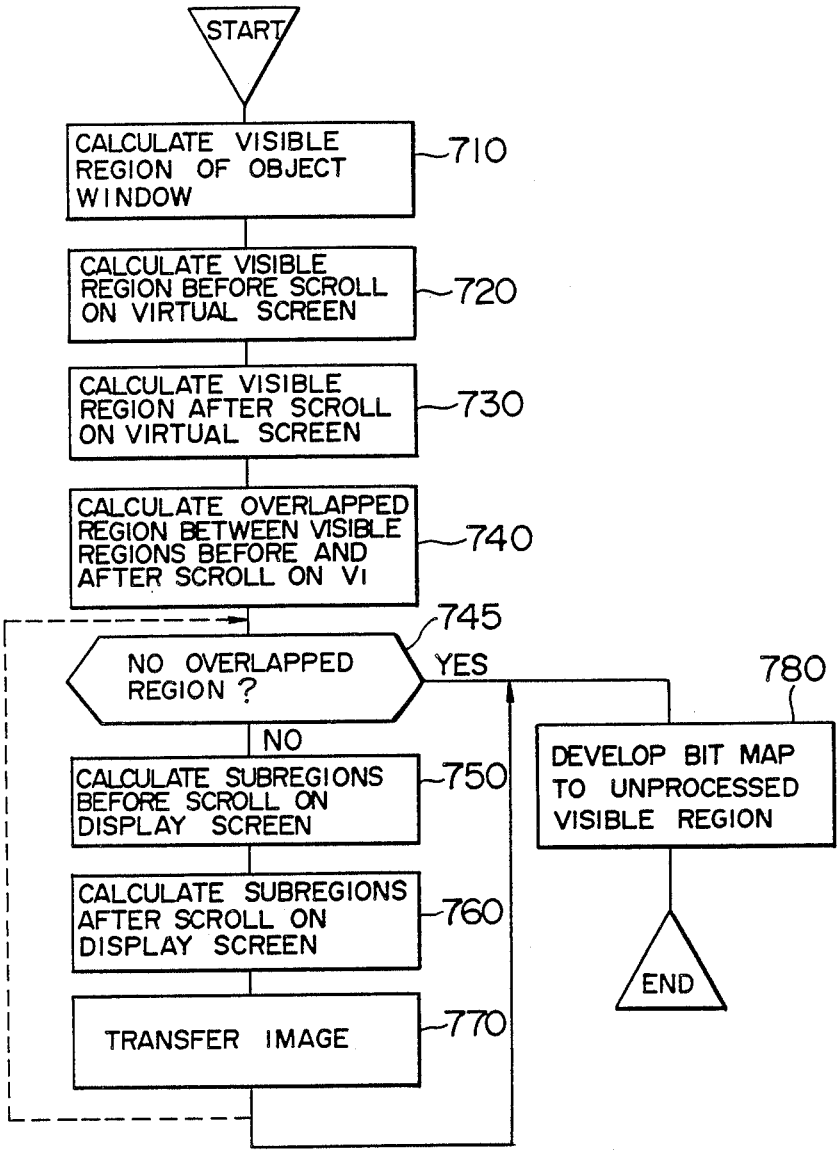
FIG. 19 is a flowchart of a program for realizing the sixth embodiment.

FIG. 19 is a flowchart showing the steps of display control for scroll operation. First, step 710 determines the visible subregions $w_{22}$ and $w_{23}$ from the subroutine SUB1 shown in the first embodiment with the window ($W_2$) to be scrolled as a target window. Step 720 determines the visible subregions 71 and 72 on the virtual screen before scroll corresponding to the visible subregions mentioned above, followed by step 730 for determining the visible subregions 81 and 82 on the virtual screen after scroll. Step 740 checks the manner in which the visual subregions before and after scroll are overlapped, and determines the overlapped regions S1, S2 and S3. If there is no overlapped region, the process is passed to step 780 to determine all the visible subregions $w_{22}$ and $w_{23}$ after scroll by bit map development of the data from the corresponding regions 81 and 82 on the vertical screen. If there is any overlapped region, on the other hand, step 750 determines the redisplay subregions S1', S2' and S3' on the display screen before scroll corresponding to the overlapped regions S1, S2 and S3, followed by step 760 for determining the subregions S1'', S2'' and S3'' on the display screne after scroll corresponding to the overlapped regions mentioned above. Step 770 transfers the contents of the redisplay subregions before scroll to the corresponding subregions after scroll on the frame memory. If the image transfer is executed for each overlapped region, the operation of the steps 750 to 770 is repeated for all the overlapped regions as shown by the dashed line. Upon completion of these processes, the process is passed to step 780, where a bit map of the data from the virtual screen is developed in the visible regions except for the redisplay regions.

We claim:

1. A method of display control for a multi-window system provided with a display screen in which a plurality of rectangular windows are set, first memory means for storing display data in positions corresponding to the windows on the display screen, second memory means for storing a plurality of display data of a virtual screen corresponding to each of said windows which displays data included in the partial region on the virtual screen corresponding thereto, third memory means for storing definition data representing the positional data on the display screen for each window and the correspondence thereof with the virtual screen, and control means for partially rewriting the display data stored in said first memory means;

the method comprising:

a first step of designating one of the windows in the display screen as an object window, the display status of which is to be changed;

a second step of sequentially selecting another window as a reference window among the rest of said windows in the display screen excepting said object window and comparing said object window with said another window selected as the reference window on the screen on the basis of the definition data stored in the third memory means to check whether said object window crosses said reference window;

a third step of dividing said object window into a subregion overlapped with said reference window and at least one rectangular non-overlapped subregion with the boundary of said overlapped subregion as a dividing line if said object window and said reference window cross each other;

a fourth step of comparing said non-overlapping subregion selected as an object rectangle with still another window selected sequentially as a reference window among the rest of said windows on the screen, and if said non-overlapped subregion selected as the object rectangle and said reference window cross each other, subdividing said non-overlapped subregion selected as object rectangle into a new subregion overlapped with said reference window and at least one rectangular non-overlapped subregion with the boundary of said new overlapped subregion as a dividing line, said comparing and subdivision being repeated by substituting said obtained non-overlapped subregion for a new object rectangular region until no more windows to be selected as said reference window remain; and a fifth step of partially applying the display data of at least one partial area in said second memory means to a corresponding partial area in said first memory means, said partial area being divided in accordance with the resultant overlapped or non-overlapped subregions, thereby changing the contents of display in the visible region occupied by the object window on the display screen.

2. A method of display control according to claim 1, wherein said reference windows are selected among only those windows having higher display priority order than the object window, said windows being selected as a reference window in the descending order of display priority, said display data being rewritten in the fifth step about the partial region of the first memory means corresponding to the non-overlapped subregion that remains finally.

3. A method of display control according to claim 2, wherein a window of which the size is to be increased is designated as said object window in said first step, and a rectangular region corresponding to the expanded part, in place of the object window of said second step, is compared with the reference window.

4. A method of display control according to claim 1, wherein a window to be deleted from the display screen is designated as said object window in said first step, said reference window is selected sequentially in the descending order of display on the display screen, said fifth step being executed to display the contents of the virtual screen corresponding to the reference window on the part of the display screen corresponding to said overlapped subregion each time an overlapped subregion is obtained, and the part of the display screen corresponding to the remaining non-overlapped subregion finally is cleared.

5. A method of display control according to claim 1, wherein a window to be reduced in size is designated as said object window in said first step, and a partial rectangular region of the object window which disappears as the result of size reduction is compared with the reference window in place of the object window in the second step.

6. A method of display control according to claim 1, wherein said object window for display control makes up a window for which the upgrading of the display order on the display screen is commanded, the windows higher in display priority order than the original display priority order of said object window are selected as said reference windows in the descending order of display, and the contents of the virtual screen corresponing to said object window are seuentiall dislayed at the part of the display screen corresponding to the overlapped subregion.

7. A method of display control according to claim 1, wherein a window for which the display position on the display screen is to be shifted to the second position from the first position is designated as said object window in said first step, said second to fourth steps being executed for the object window at said second position, said method further comprising a sixth step of determining a rectangular region in said object window at said first position corresponding to at least one non-overlapped subregion obtained for the object window at said second position, and a seventh step of comparing the rectangular region obtained in said sixth step with another window selected as a reference window among the rest of the windows on the display screen, and when said rectangular region crosses said reference window, dividing said rectangular region into a subregion overlapped with said reference window and at least one rectangular non-overlapped subregion with the boundary of said overlapped subregion as a dividing line, the comparing with other reference windows being repeated with the non-overlapped subregion as a new object rectangle, said fifth step further comprising an eighth step of shifting the display data of the final non-overlapped subregion obtained in said seventh step from the first position to the second position within said first memory means, a ninth step of applying the contents of the virtual screen of said object window corresponding to the overlapped subregion obtained in said seventh step to the non-display region in the window at said second position, and a tenth step of clearing the display data in the object window at the first position except for the overlapped subregion obtained in said seventh step.

8. A method of display control according to claim 1, wherein a window for which the contents of display are to be scrolled is designated as said object window in said first step, said method further comprising a sixth step of determining a first visible region before scroll on the virtual screen corresponding to said object window, corresponding to the non-overlapped subregion obtained through said second to fourth steps, a seventh step of determining a second visible region after scroll on the virtual screen corresponding to said object window, corresponding to said non-overlapped subregion obtained through said second to fourth steps, and an eigth step of comparing said first and second visible regions with each other to determine a mutually overlapped region as a redisplay region, said fifth step further including a ninth step of transferring the display data corresponding to said redisplay region on said first memory means to the display position after scroll, and a tenth step of applying the display data of the partial region in said second visible region except on said redisplay region to a corresponding partial region on said first memory means from said second memory means.

9. A method of display control for a multi-window system provided with a display screen in which a plurality of rectangular windows are allocated according to definition data representing the position on the display screen and the display priority order for each window, comprising the steps of:

(a) designating one of said windows to change the display status thereof;

(b) comparing on the basis of said definition data said designated window with another window selected sequentially in a predetermined order among the rest of the windows in the display screen to detect an overlap window crossing said designated window on the display screen;

(c) dividing said designated window into a subregion overlapped with said overlap window and at least one rectangular non-overlapped subregion which is the remaining portion of said designated window excepting said overlapped subregion if said overlap window is detected at step (b), (d) comparing on the basis of said definition data said non-overlapped subregion with still another window selected sequentially in said predetermined order among the rest of the windows in the display screen and subdividing said non-overlapped subregion into a new subregion overlapped with said another window and at least one new non-overlapped subregion which is the remaining portion of said non-overlapped subregion excepting said new overlapped subregion if said another window is detected to cross with said non-overlapped subregion, said comparing and subdivision being repeated by substituting said obtained new non-overlapped subregions for said non-overlapped subregion until no more windows to be compared with said non-overlapped region remain in the display screen; and (e) partially rewriting display contents of at least one partial region of the display screen corresponding to the resultant subregions.

10. A method of display control according to claim 9, wherein each said another window is selected sequentially amorg only those windows having higher display priority order than said designated window, said windows being selected as said another window in the descending order of display priority, and said rewriting of display contents being carried out about the partial region on the display screen corresponding to the non-overlapped subregion that remains finally.

11. A method of display control according to claim 9, further comprising the step of expanding the size of said designated window and the step of calculating a rectangular region corresponding to the expanded part, and wherein said calculated rectangular region, in place of said designated window, is compared with said another window and subjected to said dividing.

12. A method of display control according to claim 9, wherein said designated window is commanded to be deleted from the display screen, each said another window is selected sequentially in the descending order of display priority, said partial rewriting being carried out to display the contents of an obtained overlapped subregion in the selected another windcw each time the overlapped subregion is obtained, and the part of the display screen corresponding to the non-overlapped subregion left finally is cleared.

13. A method of display control according to claim 9, wherein said designated window is commanded to be reduced in size, and a partial rectangular region of said designated window which disappears as the result of size reduction is compared with the another window and subjected to said dividing in place of said designated window.

14. A method of display control according to claim 9, wherein said designated window is commanded to upgrade its display priority order on the display screen, each said another window is sequentially selected among the windows higher in display priority order than the original display priority order of said designated window in the descending display priority order, and the display contents of the display screen are sequentially rewritten at the part of said designated window corresponding to the overlapped subregion.

15. A method of display control according to claim 9, further comprising the step of temporarily storing in a memory means the definition data including information representing the position on the display screen for each said obtained non-overlapped subregion in correspondence with said designated window, and the step of referring said memory means when said designation of one of the windows is occurred, said steps (a) to (d) being carried out if no definition data corresponding to the newly designated window is found in said memory means.

16. A method of determining display data to be displayed in a plurality of rectangular windows on a display screen comprising:

a first step of storing basic data to be used for each of said windows;

a second step of storing definition data including positional data defining positions in display of the respective windows on the display screen and priority data indicating priorities of the respective windows in display on the display screen;

a third step of designating a specific one of said windows as an object window of which display status may be changes and selected ones of the other windows as reference windows;

a fourth step of sequentially selecting one by one said reference windows in an order of the priorities thereof;

a fifth step of comparing said object window with the first selected reference window based on the positional data thereof to determine whether said object window and said first-selected reference window overlap and if they overlap, dividing said object window into an overlapped rectangular subregion which overlaps with said first-selected reference window and a non-overlapped region including at least one rectangular non-overlapped subregion which is not overlapped with said first-selected reference window;

a sixth step of applying said fifth step to each of said non-overlapped rectangular subregions obtained by said fifth step, while replacing each of the non-overlapped rectangular subregions for said object window and a next selected one of said reference windows for said first-selected reference window;

repeating said sixth step until no more reference window remains to be compared in the fifth step; and a seventh step of determining said non-overlapped regions obtained after repetition of the sixth step as a non-overlapped area and the remaining regions of the window designated as the object window as an overlapped area and selecting display data to be displayed in each of the areas of said object window from said basic data depending on whether the area is an overlapped one or non-overlapped one.

17. A method according to claim 16, said reference windows are those which have the priorities higher than that of the specific one window and the reference windows are selected in the fourth step in an order of higher to lower priority, and wherein in the seventh step, the display data for the non-overlapped area is selected from the basic data for said specific one window.

18. A method according to claim 17, wherein when the specific one of the windows is to be increased in size by adding an additional rectangular region, said additional rectangular region is designated as the object window in place of said specific one window.

19. A method according to claim 16, wherein when the specific one of the windows is to be deleted, all the windows other than said specific one window are designated as the reference windows in the third step and wherein in the seventh step, the non-overlapped area is cleared from any display data and display data for each of the overlapped subregions obtained in any of the fifth and sixth steps is selected from the basic data to be used for the window which is selectively used as the reference window in the step where that overlapped subregion is obtained.

20. A method according to claim 16, wherein when the specific one window is to be reduced in size by deleting a selected rectangular region of the window, said selected rectangular region of the specific one window is designated as the object window in place of the specific one window and all the windows other than said specific one window are designated as the reference windows in the third step and wherein in the seventh step, the non-overlapped area is cleared from any display data and display data for each of the overlapped subregions obtained in any of the fifth and sixth steps is selected from the basic data to be used for the window which is selectively used as the reference window in the step where that overlapped subregion is obtained.

21. A method according to claim 16, wherein when the priority in display of the specific one window is to be changed to a new one higher than its original priority, those windows which have higher priorities than the original priority of the specific one window are designated as the reference windows in the third step and selected one by one in an order of higher to lower priority in the fourth step.

22. A method according to claim 16, wherein when the specific one window is to be shifted from a first position to a second position on the display screen, the specific one window after shifting is designated as the object window and those windows having the priorities higher than that of the specific one window are designated as the reference windows in the third step, and further comprising:

an eighth step of determining a display area in the specific one window before shifting corresponding to the non-overlapped area of the specific one window after shifting determined in the seventh step, said display area including at least one rectangular display subregion;

a ninth step of repeating the fourth to seventh steps, while designating the rectangular display subregion as the object window; and a tenth step of shifting the display data used in the non-overlapped area of the specific one window before shifting determined in the seventh step repeated in the ninth step into the corresponding area in the specific one window after shifting.

23. A method according to claim 16, wherein when the display data to be displayed in the specific one window on the display screen is changed from a first portion to a second portion of the basic data as stored for the specific one window, said method further comprises:

an eighth step of determining a first section of the first portion and a second section of the second portion of said basic data, both corresponding to the non-overlapped area of said specific one window determined in the seventh step;

a ninth step of determining a first part of said first section which is the same as a second part of said second section; and a tenth step of displaying the first part of the first section of the basic data at an area on the display screen positionally corresponding to the second part of the second section.

* * * * *